US005388641A

United States Patent [19]

Yee et al.

[11] Patent Number: 5,388,641

[45] Date of Patent: Feb. 14, 1995

[54] METHOD FOR REDUCING THE INERT GAS FRACTION IN METHANE-CONTAINING GASEOUS MIXTURES OBTAINED FROM UNDERGROUND FORMATIONS

[75] Inventors: Dan Yee; John P. Seidle, both of Tulsa, Okla.; Rajen Puri, Aurora, Colo.

[73] Assignee: Amoco Corporation, Chicago, Ill.

[21] Appl. No.: 147,122

[22] Filed: Nov. 3, 1993

[51] Int. Cl.[6] ..... E21B 43/18

[52] U.S. Cl. ..... 166/263; 166/268

[58] Field of Search ..... 166/263, 266, 268, 305.1; 299/4, 5

[56] References Cited

U.S. PATENT DOCUMENTS

| | | | |
|---|---|---|---|
| 4,043,395 | 8/1977 | Every et al. | 166/263 |
| 4,400,034 | 8/1983 | Chew | 299/4 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |

FOREIGN PATENT DOCUMENTS 609917 6/1978 U.S.S.R. .

OTHER PUBLICATIONS

M. G. Zabetakis, et al., "Methane Control in United States Coal Mines-1972", U.S. Bureau of Mines, Information Circular 8600, pp. 8-16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

N. Ali, P. K. Singh, C. P. Peng, G. S. Shiralkar, Z. Moschovidis and W. L. Baack, "Injection Above-Parting-Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In-Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", *Recent Advances in Hydraulic Fracturing,* vol. 12, chapter 1, pp. 1-38, S.P.E. Monograph Series, (1989).

N. R. Warpinski and Michael Berry Smith, "Rock Mechanics and Fracture Geometry", *Recent Advances in Hydraulic Fracturing,* vol. 12, chapter 3, pp. 57-80, S.P.E. Monograph Series, (1989).

"Quarterly Review of Methane from Coal Seams Technology", *Gas Research Institute,* vol. 11, No. 1, p. 38, (1993).

Carl L. Schuster, "Detection Within the Wellbore of Seismic Signals Created by Hydraulic Fracturing", SPE 7448, (1978).

(List continued on next page.)

*Primary Examiner*—George A. Suchfield

*Attorney, Agent, or Firm*—Scott P. McDonald; Richard A. Kretchmer

[57] ABSTRACT

A method for reducing the inert gas fraction volume percent present in a methane-containing mixture produced by injecting an inert gas into a solid carbonaceous subterranean formation is disclosed. The method reduces the inert gas fraction by suspending the injection of the inert gas or by reducing a rate of injection of the inert gas. Additional methods are disclosed in which the inert gas volume percent of a gaseous mixture produced from more than one well can be maintained below the inert gas volume percent present in a gas obtained from at least one of the wells.

31 Claims, 3 Drawing Sheets

OTHER PUBLICATIONS

Amoco Production Company, Handout distributed at the International Coalbed Methane Symposium held in Birmingham, Ala., May 17–21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot U.S. Environmental Protection Agency Region VIII, Transmittal Letter of Feb. 11, 1992 approving Nitrogen Injection Pilot and Associated Permits.

Nov. 9, 1990, Report of the Oil and Gas Conservation Commission of the State of Colorado.

METHOD FOR REDUCING THE INERT GAS FRACTION IN METHANE-CONTAINING GASEOUS MIXTURES OBTAINED FROM UNDERGROUND FORMATIONS

FIELD OF THE INVENTION

This invention generally relates to a method for reducing the concentration of an inert gas present in methane-containing gaseous mixtures. The invention more particularly relates to a method for reducing the concentration of an inert methane-desorbing gas present in methane-containing gaseous mixtures produced by injecting inert gas into solid carbonaceous subterranean formations such as coalbeds.

BACKGROUND OF THE INVENTION

Methane is believed to be produced by various thermal and biogenic processes responsible for converting organic matter to solid carbonaceous subterranean materials such as coals and shales. When methane is produced in this manner, the mutual attraction between the carbonaceous solid and the methane molecules frequently causes a large amount of methane to remain trapped in the solids along with water and lesser amounts of other gases which can include nitrogen, carbon dioxide, various light hydrocarbons, argon and oxygen. When the trapping solid is coal, the methane-containing gaseous mixture that can be obtained from the coal typically contains at least about 95 volume percent methane and is known as "coalbed methane." The worldwide reserves of coalbed methane are huge.

Coalbed methane has become a significant source of the methane distributed in natural gas. Typically, coalbed methane is recovered by drilling a wellbore into a subterranean coalbed having one or more methane-containing coal seams that form a coalbed. The pressure difference between the ambient coalbed pressure (the "reservoir pressure") and the wellbore provides a driving force for flowing coalbed methane into the wellbore. As the ambient coalbed pressure decreases, methane is desorbed from the coal. Unfortunately, this pressure reduction also reduces the driving force necessary to flow methane into the wellbore. Consequently, pressure depletion of coalbeds becomes less effective with time, and is generally believed capable of recovering only about 35 to 50% of the methane contained therein.

An improved method for producing coalbed methane is disclosed in U.S. Pat. No. 5,014,785 to Puri, et al. In this process, a methane-desorbing gas such as an inert gas is injected through an injection well into a solid carbonaceous subterranean formation such as a coalbed. At the same time, a methane-containing gas is recovered from a production well. The desorbing gas, preferably nitrogen, mitigates bed pressure depletion and is believed to desorb methane from the coalbed by decreasing the methane partial pressure within the bed. Recent tests confirm that this process yields increased coalbed methane production rates and suggest that the total amount of recoverable methane may be as high as 80% or more.

As will be demonstrated by an Example contained herein, long-term injection of an inert gas into a formation may result in the production of a methane-containing gas having an inert gas fraction that generally increases in volume percent with time. This result may be undesirable as it may be necessary to lessen the concentration of injected inert gas in the produced methane-containing mixture before the mixture can be transferred into a natural gas pipeline or otherwise utilized.

What is needed is an improved process for the recovery of methane from solid carbonaceous subterranean formations that can provide a methane-containing gas that contains as little of the injected inert gas as possible to mitigate the costs associated with removing the injected gas from the produced methane-containing gaseous mixture.

SUMMARY OF THE INVENTION

Each aspect of the invention described exploits our discovery that the inert gas fraction present in a methane-containing gas produced by injecting an inert methane-desorbing gas into a solid subterranean carbonaceous formation can be reduced on a volume percent basis by temporarily suspending injection of the inert gas or by reducing the injection rate of the inert gas.

The inert gas content of a produced methane-containing mixture is of significant economic importance. The presence of inert gas in the produced gaseous mixture reduces the methane content and therefore the fuel value of a given volume of the produced gaseous mixture. Additionally, in some cases, it will be necessary to reduce the amount of inert gas in the produced gaseous mixture so that the mixture can be used in a chemical process or transferred to a natural gas pipeline. Temporarily suspending inert gas injection to reduce the inert gas volume percent present in the produced methane-containing gaseous mixture therefore can reduce operating costs by reducing the need to remove inert gas from the produced mixture.

It is believed that in some cases, a beneficial effect similar to that obtained by suspending inert methane-desorbing gas injection may be obtained simply by reducing the injection rate of the inert gas into the formation. Additional benefits can be obtained by staggering the suspension or reduction of inert gas injection into multiple wells so that the output from the wells may be mixed to produce a mixture containing a lower average volume percent of inert gas than could otherwise be obtained from wells in which changes in injection flow are not staggered with respect to time.

A first aspect of the invention is directed to a method for reducing the amount of an inert methane-desorbing gas present in a methane-containing gaseous mixture produced from a solid carbonaceous subterranean formation, the method comprising the steps of injecting an inert methane-desorbing gas into the formation; suspending injection of the methane-desorbing gas; recovering a first methane-containing gaseous mixture from the formation during at least a portion of the injecting step, said mixture having a methane-desorbing gas volume percent of Y percent; and recovering a second methane-containing gas from the formation after performing the suspending step, said second gas having a methane-desorbing gas volume percent less than Y percent.

The term "solid carbonaceous subterranean formation" as used herein refers to any underground geological formation which contains methane in combination with significant amounts of solid organic material. Solid carbonaceous subterranean formations include but are not limited to coals and shales.

The term "inert methane-desorbing gas" as used herein refers to any gas or gaseous mixture that contains greater than fifty volume percent of a relatively inert gas or gases. A relatively inert gas is a gas that promotes the desorption of methane from a solid carbonaceous subterranean formation without being strongly adsorbed to the solid organic material present in the formation or otherwise chemically reacting with the solid organic material to any significant extent. Examples of relatively inert gases include nitrogen, argon, air, helium and the like, as well as mixtures of these gases. An example of a strongly adsorbed gas not considered to be a relatively inert gas is carbon dioxide.

The term "methane-desorbing gas volume percent" refers to the volume percent of the inert methane-desorbing gas found in the produced methane-containing gaseous mixture at a given point in time that is attributable to the injection of the methane-desorbing gas. It should be noted that if a multi-component inert methane-desorbing gas is used, some components of the gas may appear in the produced gas before others or in varying ratios. In this case, the methane-desorbing gas volume percent refers to the sum of all inert gas components actually appearing in the produced gas. If the formation produces any naturally-occurring inert gas components identical to one or more components injected into the formation, the naturally-occurring portion of the components should be subtracted from the detected amount to determine the methane-desorbing gas volume percent attributable to inert gas injection.

The term "recovering" as used herein means a controlled collection and/or disposition of a gas, such as storing the gas in a tank or distributing the gas through a pipeline. "Recovering" specifically excludes venting the gas into the atmosphere.

A second aspect of the invention is directed to a method for reducing the amount of an inert methane-desorbing gas present in a methane-containing mixture produced from a solid carbonaceous subterranean formation, the method comprising the steps of injecting an inert methane-desorbing gas at a first rate into the formation; decreasing the rate of injection of the methane-desorbing gas to a second rate; recovering a first methane-containing gaseous mixture from the formation while injecting the inert gas at the first rate, said mixture having a methane-desorbing gas volume percent of Y percent; and recovering a second methane-containing gas from the formation while injecting at the second rate, said second gas having a methane-desorbing gas volume percent less than Y percent.

A third aspect of the invention is directed to a method for reducing the amount of an inert methane-desorbing gas present in a methane-containing gaseous mixture produced from one or more solid carbonaceous subterranean formations, the method comprising the steps of injecting a first inert methane-desorbing gas at a first rate into a first formation location; decreasing the rate of injection of the first inert methane-desorbing gas to a second rate; recovering a first methane-containing gaseous mixture from a first production well during at least a portion of the decreasing step, said mixture having an inert methane-desorbing gas volume percent of Y percent; and mixing the first methane-containing gaseous mixture with a second methane-containing gaseous mixture to produce a third methane-containing gaseous mixture having a methane-desorbing gas volume percent less than Y percent.

As used herein, the term "formation location" refers to a location within a solid carbonaceous subterranean formation into which an inert methane-desorbing gas can be injected to increase methane-containing gas production from a production well in fluid communication with the point of gas injection. Inert gas typically is injected from the surface into such a location through one or more injection wells bored into the formation.

In each of the forgoing aspects of the invention, a preferred solid carbonaceous underground formation is a coalbed. The term "coalbed" as used herein refers to a single coal seam or a plurality of coal seams which contain methane and through which an injected gas can be propagated.

In other preferred embodiments of the invention, the injection of an inert gas increases the production of a methane-containing gaseous mixture from a solid carbonaceous subterranean formation such as a coalbed from a standard initial production rate to an enhanced production rate.

The term "standard initial production rate" as used herein refers to the actual or predicted methane-containing gas production rate of a production well immediately prior to flowing a methane-desorbing gas through the well to increase its production rate. A standard initial production rate may be established, for example, by allowing a well to operate as a pressure depletion well for a relatively short period of time just prior to inert gas injection. The standard initial production rate can then be calculated by averaging the production rate over the period of pressure depletion operation. If this method is used, the well preferably will have been operated long enough that the transient variations in production rates do not exceed about 25% the average production rate. Preferably, the standard initial production rate is determined by maintaining constant operating conditions such as operating at a constant bottom hole flowing pressure with little or no fluid level. Alternatively, a standard initial production rate may be calculated based on reservoir parameters, as discussed in detail herein, or as otherwise would be calculated by one of ordinary skill in the art.

As used herein, an "enhanced production rate" for a given well is any rate greater than the standard initial production rate which is caused by the injection of an inert methane-desorbing gas into the formation. In most cases, it is believed that the enhanced production rate of the well will remain greater than the standard initial production rate of the well for a substantial period of time following the suspension of inert methane-desorbing gas injection or a reduction of inert gas injection rate, thereby retaining some of the advantages of enhanced production at a reduced methane-desorbing gas volume percent. Where the term "fully-enhanced production rate" is used, the term refers to the maximum steady-state production rate caused by continuously injecting the inert methane-desorbing gas into the formation at a given injection rate.

DETAILED DESCRIPTION OF THE INVENTION

Figure 1:
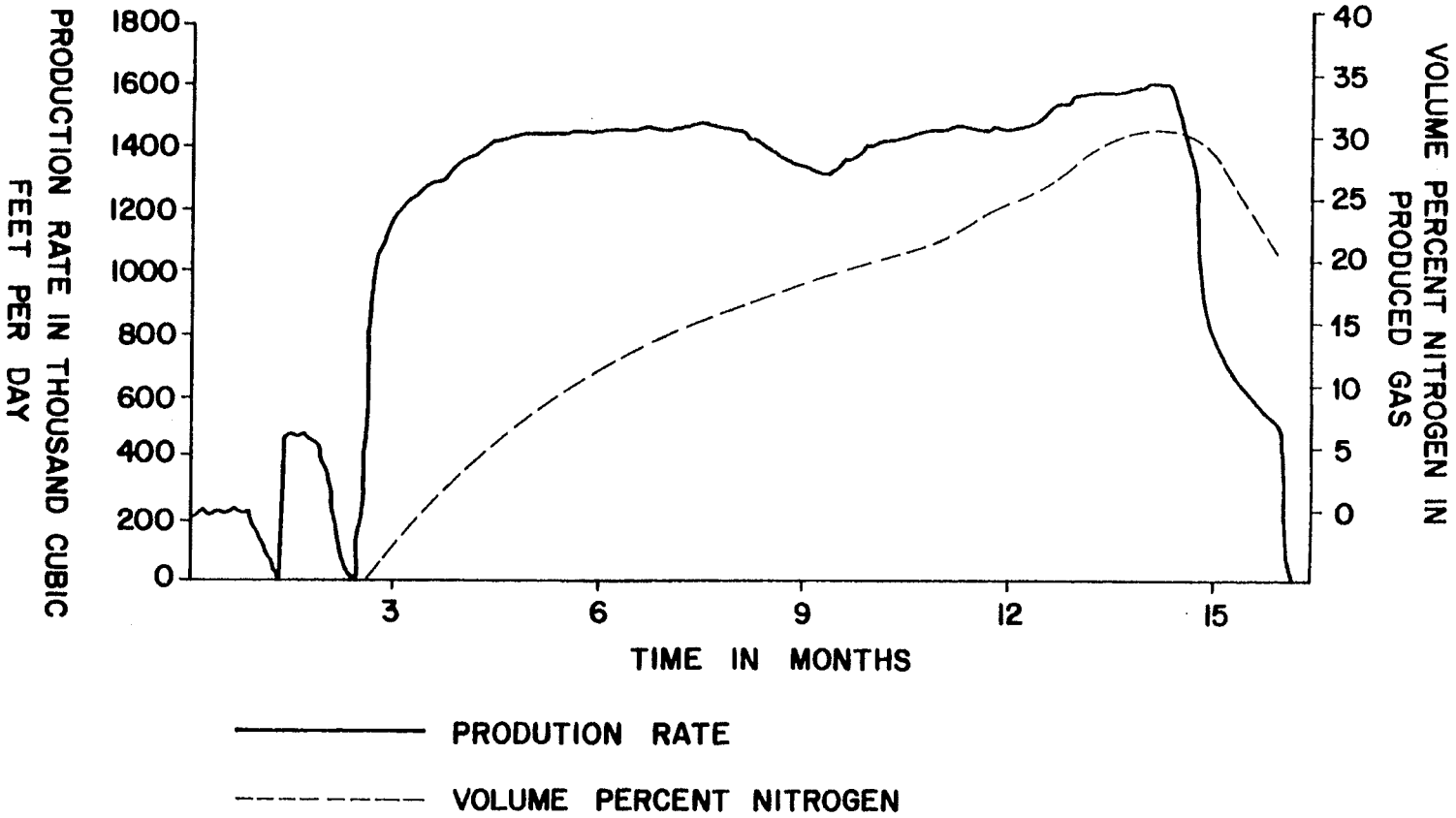
FIG. 1 is a plot of total gas production and volume percent nitrogen present in a produced gas for a pilot plant operated in accordance with the present invention.

The following detailed description describes several processes in accordance with the present invention. Each process exploits our surprising discovery that volume percent of inert methane-desorbing gas in a methane-containing gaseous mixture produced by injecting an inert methane-desorbing gas into a formation can be reduced by suspending injection of the inert gas or by reducing the rate of inert gas injection.

The embodiments of the invention explained below are meant to be illustrative only. While many of these embodiments are processes in which nitrogen is injected into a coalbed, the description of these embodiments is not meant to limit the type of injected gas used or the type of methane-containing formation into which gas can be injected beyond that which is recited in the appended claims.

Each embodiment of the invention requires as a first step the injection of an inert methane-desorbing gas into a solid carbonaceous subterranean formation such as a coalbed. The methane-desorbing gas typically is injected into the formation through one or more injection wells terminating in or in fluid communication with the formation.

Inert methane-desorbing gases suitable for use in the invention include any gas or gaseous mixture that contains greater than fifty volume percent of a relatively inert gas or gases. A relatively inert gas is a gas that promotes the desorption of methane from a solid carbonaceous subterranean formation without being significantly adsorbed to the solid organic material present in the formation or otherwise reacting with the solid organic material. Examples of relatively inert gases include nitrogen, argon, air, helium and the like, as well as mixtures of these gases. An example of a strongly adsorbed gas not considered to be a relatively inert gas is carbon dioxide.

As used herein, the term "air" refers to any gaseous mixture containing at least 15 volume percent oxygen and at least 60 volume percent nitrogen. Preferably, "air" is the atmospheric mixture of gases found at the well site and contains between about 20 and 22 volume percent oxygen and 78 and 80 volume percent nitrogen.

Although atmospheric air is a cheap and plentiful inert methane-desorbing gas suitable for use in the invention, nitrogen-rich gases having a greater volume percent of nitrogen than is present in air, such as an oxygen-depleted atmospheric airs having greater than about 80 volume percent nitrogen, are the preferred inert methane-desorbing gases. A preferred feedstock for producing nitrogen-rich gases is atmospheric air, although other gaseous mixtures of oxygen and less reactive gases may be used if available. Such other mixtures may be produced by using or mixing gases obtained from processes such as the cryogenic upgrading of nitrogen-containing low BTU natural gas.

Preferably, the injected gas contains at least 90 volume percent nitrogen, but most preferably, greater than 95 volume percent nitrogen. Many techniques for producing nitrogen-enriched gaseous mixtures from nitrogen-containing gaseous mixtures are known in the art. Three suitable techniques are membrane separation, pressure swing adsorption and cryogenic separation. It should be noted that each of these methods can also be used to produce other suitable inert methane-desorbing gases and mixtures thereof from feedstocks other than atmospheric air if such feedstocks are sufficiently available.

If membrane separation techniques are employed to produce a nitrogen-rich mixture from air, air should be introduced into the membrane separator unit under pressure, preferably at a rate sufficient to produce an oxygen-depleted gaseous effluent stream having a nitrogen to oxygen volume ratio of at least 9:1. Any membrane separator unit capable of separating oxygen from nitrogen can be used for this purpose. One such membrane separator is the "NIJECT" unit available from Niject Services Co. of Tulsa, Okla. Another suitable unit is the "GENERON" unit available from Generon Systems of Houston, Tex.

Membrane separators such as the "NIJECT" and "GENERON" units typically include a compressor section for compressing air and a membrane section for fractionating the air. The membrane sections of both the "NIJECT" and "GENERON" separation units employ hollow fiber membrane bundles. The membrane bundles are selected to be relatively more permeable to a gas or gases required in a first gas fraction such as oxygen, and relatively impermeable to a gas or gases required to be in a second gas fraction, such as nitrogen, carbon dioxide and water vapor. Inlet air is compressed to a suitable pressure and passed through the fibers or over the outside of the fibers.

In a "NIJECT" separator, compressed air on the outside of the hollow fibers provides the driving energy for having oxygen, carbon dioxide and water permeate into the hollow fibers while oxygen-depleted nitrogen remains outside of the fibers. The nitrogen-rich effluent leaves the unit at about the inlet pressure of 50 psi or higher, typically at a pressure of at least 100 psi.

In a "GENERON" separator, compressed air passes through the inside of the hollow fibers. This provides the energy to drive the oxygen-enriched air through the fiber walls. The nitrogen-rich gas inside the fibers leaves the separator at an elevated pressure of 50 psi or higher, also typically at a pressure of at least 100 psi.

Because the nitrogen-rich gas must be injected into formations which typically have an ambient reservoir pressure between about 500 and 2000 psi, it is preferred to use membrane separators which discharge the oxygen-deficient air at as high a discharge pressure as possible, as this reduces subsequent gas compression costs.

Membrane separators like those just discussed typically operate at inlet pressures of about 50 to 250 psi, and preferably about 100 to 200 psi, at a rate sufficient to reduce the oxygen content of the nitrogen-rich effluent to a volume ratio of nitrogen to oxygen of about 9:1 to 99:1. Under typical separator operating conditions, higher pressures applied to the membrane system increase gas velocity and cause the gas to pass through the system more quickly, thereby reducing the separating effectiveness of the membrane. Conversely, lower air pressures and velocities provide for a more oxygen-depleted effluent, but at a lower rate. It is preferable to operate the membrane separator at a rate sufficient to provide an oxygen-depleted effluent containing about 2 to 8 volume percent oxygen. When atmosphere air containing about 20 volume percent oxygen is processed at a rate sufficient to produce an oxygen-deficient fraction containing about 5 volume percent oxygen, the oxygen-enriched air fraction typically contains about 40 volume percent oxygen. Under these conditions, the nitrogen-rich effluent leaves the membrane separator at a superatmospheric pressure typically less than about 200 psi. Additional information concerning the use of membrane separators in enhanced methane production processes can be found in co-filed U.S. Ser. No. 07/147,111, which is hereby incorporated by reference.

Nitrogen-rich methane-desorbing gases may also be produced from air by a pressure swing adsorption process. This process typically requires first injecting air under pressure into a bed of adsorbent material that preferentially adsorbs oxygen over nitrogen. The air injection is continued until a desired saturation of the bed of material is achieved. The desired adsorptive saturation of the bed can be determined by routine experimentation.

Once the desired adsorptive saturation of the bed is obtained, the material's adsorptive capacity is regenerated by lowering the total pressure on the bed, thereby causing the desorption of an oxygen-enriched process stream. If desired, the bed can be purged before restarting the adsorption portion of the cycle. Purging the bed in this manner insures that oxygen-enriched residual gas tails will not reduce the bed capacity during the next adsorptive cycle. Preferably, more than one bed of material is utilized so that one adsorptive bed of material is adsorbing while another adsorptive bed of material is being depressurized or purged.

The pressure utilized during the adsorption and desorption portions of the cycle and the differential pressure utilized by the adsorptive separator are selected so as to optimize the separation of nitrogen from oxygen. The differential pressure utilized by the adsorption separator is the difference between the pressure utilized during the adsorption portion of the cycle and the pressure utilized during the desorption portion of the cycle. The cost of pressurizing the injected air is important to consider when determining what pressures to use.

The flow rate of the nitrogen-rich stream removed during the adsorption portion of the cycle must be high enough to provide an adequate flow but low enough to allow for adequate separation of the components of the air. Typically, the rate of air injection is adjusted so that, in conjunction with the previous parameters, the recovered nitrogen-rich effluent stream has a nitrogen-to-oxygen volume ratio of about 9:1 to 99:1.

Generally, the higher the inlet pressure utilized, the more gas that can be adsorbed by the bed. Also, the faster the removal of oxygen-depleted gaseous effluent from the system, the higher the oxygen content of the gaseous effluent. In general, it is preferred to operate the pressure swing adsorption separator at a rate sufficient to provide nitrogen-rich gas containing about 2 to 8 volume percent oxygen. In this way, it is possible to maximize production of nitrogen-rich gas and at the same time obtain the advantages implicit in injecting the nitrogen-rich gas into the formation.

A wide variety of adsorbent materials are suitable for use in a pressure swing adsorption separator. Adsorbent materials which are particularly useful include carbonaceous materials, alumina-based materials, silica-based materials, and zeolitic materials. Each of these material classes includes numerous material variants characterized by material composition, method of activation, and the selectivity of adsorption. Specific examples of materials which can be utilized are zeolites having sodium aluminosilicate compositions such as "4A"-type zeolite and "RS-10" (a zeolite molecular sieve manufactured by Union Carbide Corporation), carbon molecular sieves, and various forms of activated carbon. Additional information concerning the use of pressure swing adsorbers in enhanced methane production processes can be found in co-filed U.S. Ser. No. 08/147,125, which is hereby incorporated by reference.

A third method for preparing a nitrogen-rich gas from air is cryogenic separation. In this process, air is first liquified and then distilled into an oxygen fraction and a nitrogen fraction. While cryogenic separation routinely can produce nitrogen fractions having less than 0.01 volume percent oxygen contained therein and oxygen fractions containing 70 volume percent or more oxygen, the process is extremely energy-intensive and therefore expensive. Because the presence of a few volume percent oxygen in a nitrogen-rich gas is not believed to be detrimental when such a stream is used to enhance methane recovery from a methane-containing formation, the relatively pure nitrogen fraction typically produced by cryogenic separation will not ordinarily be cost-justifiable.

Other methods for producing suitable inert gas mixtures will be known to those skilled in the art. Matters to be considered when choosing an inert methane-desorbing gas include the availability of the gas at or near the injection site, the cost to produce the gas, the quantity of gas to be injected, the volume of methane displaced from the solid methane-containing material by a given volume of the inert gas, and the cost and ease of separating the gas from the mixture of methane and inert gas collected from the formation.

The inert methane-desorbing gas must be injected into the solid carbonaceous subterranean formation at a pressure higher than the reservoir pressure and preferably lower than the parting pressure of the formation. If the injection pressure is too low, the gas cannot be injected. If the injection pressure is too high and the formation fractures, the gas may be lost through-the fractures. In view of these considerations and the pressure encountered in typical formations, the methane-desorbing gas typically will be pressurized to about 400 to 2000 psi in a compressor before injecting the stream into the formation through one or more injection wells terminating in or in fluid communication with the formation.

In some cases, it may be desirable to inject methane-desorbing gases into a formation at a pressure above the formation parting pressure if fractures are not induced which extend from an injection well to a production well. Injection pressures above the formation parting pressure may cause additional fracturing that increases formation injectability, which in turn can increase methane recovery rates. Preferably, the fracture half-lengths of formation fractures induced by injecting above the formation parting pressure are less than about 20% to about 30% of the spacing between an injection well and a production well. Also, preferably, the induced fractures should not extend out of the formation.

Parameters important to methane recovery such as fracture half-length, azimuth, and height growth can be determined using formation modeling techniques known in the art. Examples of such techniques are discussed in John L. Gidley, et al., Recent Advances in Hydraulic Fracturing, Volume 12, Society of Petroleum Engineers Monograph Series, 1989, pp. 25–29 and pp. 76–77; and Schuster, C. L., "Detection Within the Wellbore of Seismic Signals Created by Hydraulic Fracturing," paper SPE 7448 presented at the 1978 Society of Petroleum Engineers' Annual Technical Conference and Exhibition, Houston, Tex., Oct. 1–3.

Alternatively, fracture half-lengths and orientation effects can be assessed using a combination of pressure transient analysis and reservoir flow modeling such as described in paper SPE 22893, "Injection Above Fracture Parting Pressure Pilot, Valhal Field, Norway," by N. Ali et al., 69th Annual Technical Conference and Exhibition of the Society of Petroleum Engineers, Dallas, Tex., Oct. 6–9, 1991. While it should be noted-that the above reference describes a method for enhancing oil recovery by injecting water above the formation parting pressure, it is believed that the methods and-techniques discussed in SPE 22893 can be adapted to enhance methane recovery from a solid carbonaceous subterranean formation such as a coalbed.

Inert gas injection rates useful in the invention can be determined empirically. Typical injection rates can range from about 300,000 to 1,500,000 standard cubic feet per day with the higher rates being preferred. The injection of the methane-desorbing gas into the formation may be continuous or discontinuous, although generally continuous injection is preferred. The injection pressure may be maintained constant or varied, with relatively constant pressure being preferred.

Injection of the inert gas into the formation generally enhances the production of methane from the formation. The timing and magnitude of the increase in the rate of methane recovery from a production well will depend on many factors including, for example, well spacing, seam thickness, cleat porosity, injection pressure and injection rate, injected gas composition, sorbed gas composition, formation pressure, and cumulative production of methane prior to injection of the inert gas.

In most cases, gaseous methane-containing mixture will be recovered from the solid carbonaceous subterranean formation through one or more production wells in fluid communication with-the injection well or wells. Preferably, the production well terminates in one or more methane-containing seams, such as coal seams located within a coalbed. While intraseam termination is preferred, the production well need not terminate in the seam as long as fluid communication exists between the methane-containing portion of the formation and the production well. In many cases, it will be preferable to operate more than one production well in conjunction with one or more injection wells. The production well is operated in accordance with conventional coalbed methane recovery wells. It may, in some cases, be preferable to operate the production well at minimum possible backpressure to facilitate the recovery of the methane-containing fluid from the well.

Spacing between an injection and production well is believed to affect both the quantity and quality of gas withdrawn from a production well during inert gas injection. All other things being constant, a smaller spacing between injection and productions wells typically will result in both an increase in the recovery rate of methane and a shorter time before injected inert gas appears at a production well. When spacing the wells, the desirability of a rapid increase in methane production rate must be balanced against other factors, such as earlier inert gas breakthrough in the recovered gaseous mixture.

If the spacing between the wellbores is too small, the injected gas will pass through the formation to the production well without being efficiently utilized to desorb methane from within the carbonaceous matrix.

In most cases, injection and production wells will be spaced 100 to 10,000 feet apart, with 1000 to 5000 feet apart being typical. It is believed that the effect of injected gas on production rate at a distant production well generally decreases with increased spacing between the injection and production well.

Preferably, the methane-containing gaseous mixture recovered from the well typically will contain at least 65 percent methane by volume, with a substantial portion of the remaining volume percent being the methane-desorbing gas injected into the formation. Relative fractions of methane, oxygen, nitrogen and other gases contained in the produced mixture will vary with time due to methane depletion and the varying transit times through the formation for different gases. In the early stages of well operation, one should not be surprised if the recovered gas closely resembles the in situ composition of coalbed methane. After continued operation, significant amounts of the injected inert gas can be expected in the recovered gas.

The fully-enhanced production rate of a methane-containing gaseous mixture produced during inert gas injection is expected to exceed a standard initial production rate of a given well by a factor of about 1.1 to about 5 times, or in some cases, 10 times or more. The term "standard initial production rate" refers to the actual or predicted methane-containing gas production rate of a production well just before flowing a methane-desorbing gas through the well to increase its production rate. A standard initial production rate may be established by allowing a well to operate as a pressure depletion well for a relatively short period of time immediately preceding inert gas injection. The standard initial production rate can then be calculated by averaging the production rate over that period of time. If this method is used, the well preferably will have been operated long enough that the transient variations in production rates do not exceed about 25 percent of the average production rate. Preferably the "standard initial production rate" is determined by maintaining constant operating conditions such as operating at a constant bottom hole flowing pressure with little or no fluid level.

Where actual production rate data is unavailable, a "standard initial production rate" may be calculated based on various reservoir parameters. Such calculations are well-known in the art, and can yield production estimates based on parameters such as-the results of well pressure tests or the results of core analyses. Examples of such calculations can be found in the 1959 Edition of the "Handbook of Natural Gas Engineering" published by the McGraw-Hill Book Company, Inc., of New York, N.Y. While such estimates should prove to be accurate within a factor of two or so, it is preferred to determine the "standard initial production rate" by actually measuring produced gas.

Injection of the inert methane-desorbing gas may be terminated at any time after an enhanced production rate has been established. Typically, injection will be terminated when the amount of inert gas present in the produced methane-containing mixture exceeds a particular composition limit, or because the injection equipment is believed to be more useful at another site.

After termination of inert gas injection, two heretofore unexpected events have been observed. First, although the total production rate declines, the production rate remains enhanced above the standard initial production rate of the well for a significant period of time. Additionally, where inert gas has been found in the methane-containing gas withdrawn from the production well, the volume percent of inert gas in the mixture decreases with time. These effects are illustrated by-the following Example.

EXAMPLE 1

A pilot plant test of this invention was carried out in a coalbed methane field containing two production wells. Each of the production wells was producing a methane-containing gas for about 4 years prior to this test from a twenty-foot thick coal seam located at an approximate depth of 2,700 feet below the surface. One of the production wells was removed from service to be used as an injection well, and three additional injection wells were provided by drilling into the same coal seam at three additional locations. The five wells can be visualized as a "five spot" on a domino covering an 80-acre square area with the injection wells surrounding the production well (i.e. the injection wells were located at the corners of the "five spot" about 1800' from each other).

Inlet air was compressed to about 140 psig by two air compressors in parallel and passed through a skid mounted 10×10×20' "NIJECT" membrane separation unit equipped with hollow fiber bundles. The compressed air on the outside of the fibers provided the driving energy for oxygen, $CO_2$ and water vapor to permeate the hollow fibers, while a oxygen-depleted, nitrogen-rich stream passed outside of the fiber. About 540,000 cubic feet of oxygen-enriched air containing about 40% by volume oxygen exited the unit each day. Nitrogen-rich gas containing between about 4 to 5 volume percent oxygen exited the membrane separation unit at about the inlet pressure. This nitrogen-rich gas was compressed to approximately 1000 psig in a reciprocating electric injection compressor and injected into the four injection wells at a rate of about 300,000 cubic feet per day per well for several months.

Within one week after injection began, the volume of gas produced from the production well increased from the measured standard initial production rate of 200,000 cubic feet of gas per day to a fully-enhanced production rate of between 1.2 to 1.5 million cubic feet of gas per day. Injection of the nitrogen-rich gas continued for about one year. During the one-year injection period, the fully-enhanced production remained relatively constant. Initially the well produced very little nitrogen, but over time the nitrogen content increased steadily to about 35 volume percent. FIG. 1 illustrates a smoothed average of-total well production and percent nitrogen found in the produced methane-containing gaseous mixture before, during and after injection of the nitrogen-rich gas.

After injection of the inert gas was terminated, the production rate declined sharply at first, but then began to fall off more slowly. Over the forty-day "tail" period after injection was terminated, well production surprisingly never decreased below about 400,000 standard cubic feet per day, about a factor of 2 greater than the standard initial production rate of the well. Furthermore, during this forty-day period, the volume percent of nitrogen found in the produced gas unexpectedly decreased from an initial value of about 35 volume percent to a final value of about 25 volume percent.

The inventive process exploits these surprising findings. Prior to the discovery of these phenomena, one of ordinary skill might conclude that injection and production should be terminated when the inert gas present in the recovered methane-containing mixture increased to an undesired volume percent. To the contrary, our Example 1 shows that enhanced production levels of a gas having a continually decreasing inert gas fraction are available for a substantial period of time following the termination of inert gas injection. Thus, a preferred process is to continue to recover the methane-containing product after injection of the inert gas is terminated, rather than to simply cap the well and move on to another site as might otherwise be done.

It is believed that both the rate of decline in recovery rate and rate of decline in inert gas concentration during the post-injection period just described will vary for any given injection and production well system. In addition to the basic geological parameters affecting natural gas production generally, factors believed to affect the decline in recovery rate and inert gas concentration include the duration and magnitude of inert gas injected, the type or types of inert gas injected, and amount of formation methane depletion. Variability in the foregoing factors may also in some cases result in a time delay between suspension of injection and observed effect at-the production well. The process just described can be operated in a cyclical fashion to provide additional operating advantages as illustrated by Example 2, below.

EXAMPLE 2

Figure 2:
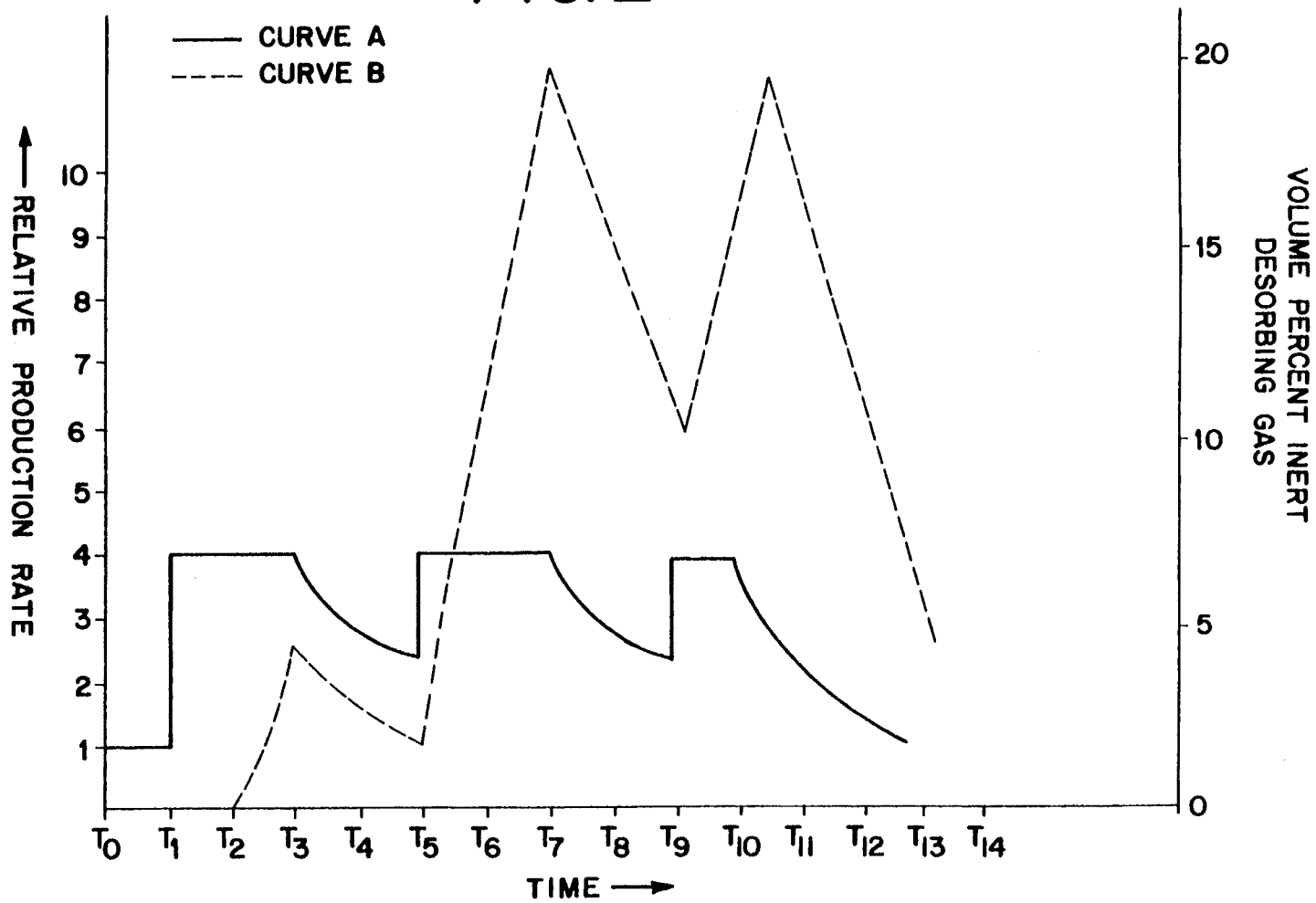
FIG. 2 is a graph of total gas production and inert methane-desorbing gas volume percent as a function of time for a well operated in accordance with the present invention.

In this Example, the production rate of a single hypothetical natural gas well is stimulated by the injection of an inert methane-desorbing gas such as a gaseous mixture containing about 95 volume percent nitrogen. As shown on FIG. 2, the well produces at a standard initial production rate of 1 volume per unit time from a time T0 to a time T1 as indicated on Curve A. At time T1, the inert methane-desorbing gas is injected into a formation location in fluid communication with the producing well, causing the production rate of the well to increase to a fully-enhanced rate of 4 volumes per unit time from time T1 to time T3. Starting at time T2, the inert gas begins to appear in the produced gas, as indicated on Curve B, reaching a value of about 5 volume percent at time T3. At time T3, inert gas injection equipment becomes unavailable, causing inert gas injection to be suspended until time T5. During the time period from T3 to T5, the production rate of the well decreases to 3 volumes per unit time and the volume percent of inert gas present in the produced gas decreases to about 2.5 volume percent.

At time T5, inert gas injection resumes. The production rate of the well returns to about 4 volumes per unit time, and the volume percent of inert gas in the produced gas increases slowly until an operational upper limit of twenty volume percent is reached. When the limit is reached, inert gas injection is once again suspended, allowing production to continue during a period of declining inert volume percent in the produced gas running from time T7 through time T9. At time T9, injection resumes to increase the production rate until the operational inert gas volume percent limit of 20 percent is reached again at time T10, at which time injection is again suspended.

This Example illustrates that suspending inert gas injection during the time period from T7 to T9 permits recovery from the production well to continue beyond the point in time at which the inert gas content operational limit is first reached. This result is only possible because of our unexpected discovery that the inert gas volume percent of the produced mixture steadily declines during a period of suspended injection when a well is operated in accordance with the present invention. It should also be noted that even though inert gas injection is suspended between times T3 and T5 and again between times T7 and T9, the production rate of the well remains enhanced above the standard initial production rate of I volume per unit time.

Additional advantages accrue when multiple wells are operated in a cyclical, "out-of-phase" mode in accordance with the present invention. This type of operation is demonstrated in Example 3, below.

EXAMPLE 3

In this Example, the production rate of two hypothetical natural gas wells is stimulated by the injection of an inert methane-desorbing gas such as atmospheric air. A first well produces a methane-containing gaseous mixture as indicated by Curves A and B on FIG. 3. Curves A and B are identical to those already presented in Example 2 and shown in FIG. 2.

Figure 3:
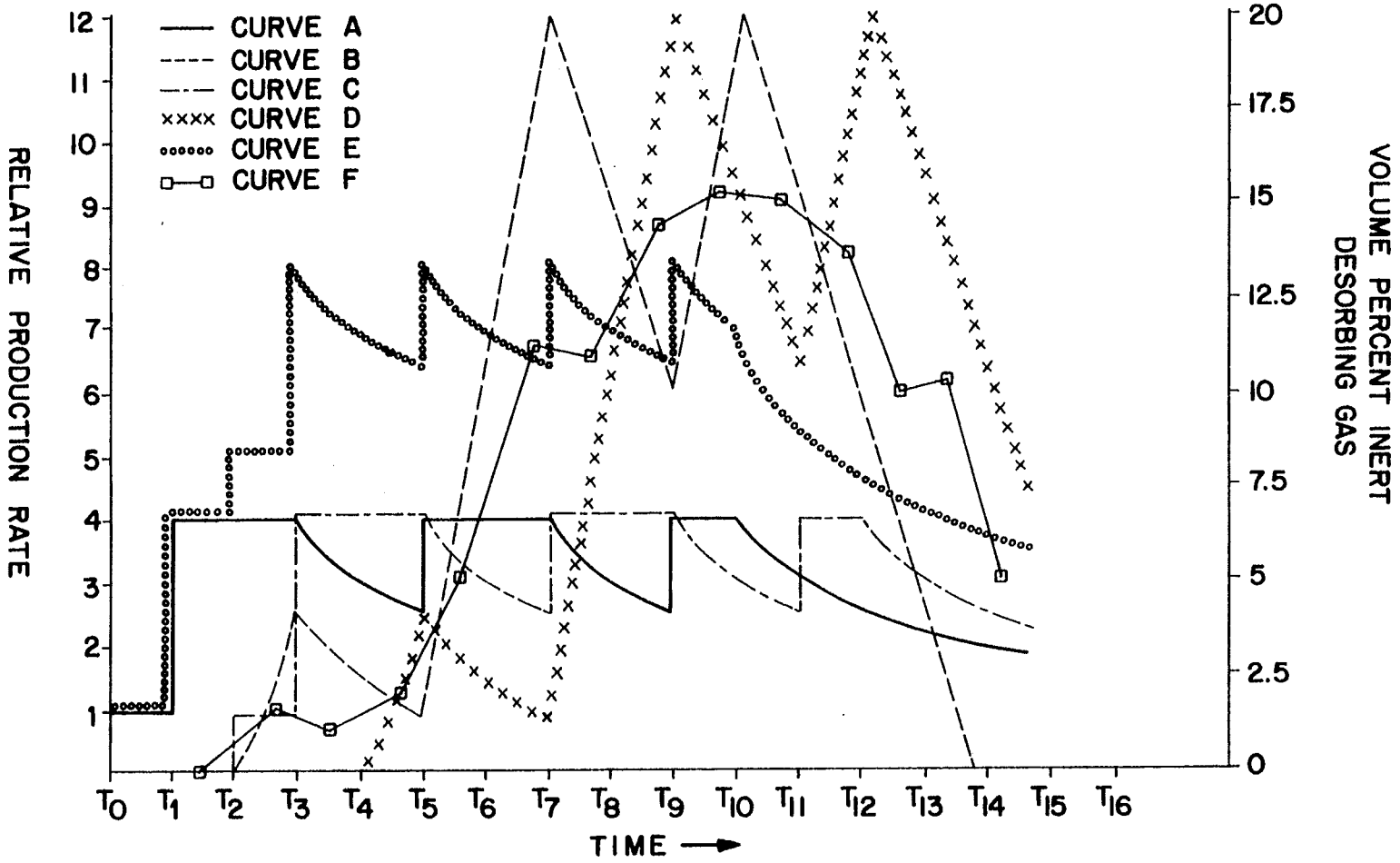
FIG. 3 is a graph of individual and composite total gas production and inert methane-desorbing gas volume percent as a function of time for a pair of wells operated in accordance with the present invention.

A second well having an identical operating history to the first well but placed in operation two time units later than the first well produces a second methane-containing gaseous mixture at a rate and inert gas volume percent as indicated by Curves C and D on FIG. 3, respectively.

The production of the first and second wells is combined and is transferred to a pipeline system that cannot accept a methane-containing mixture containing greater than 18 volume percent of inert methane-desorbing gas. The combined production of-the first and second wells and the inert gas volume percent of the combined produced gases are indicated by Curves E and F, respectively.

As can be seen by comparing Curves B, D and E, even though both the first and second wells produce methane-containing mixtures having as much as 20 volume percent of inert gas, operating both wells in a cyclical process in which the inert gas maxima occur at different times, or "out-of-phase," permits the individual productions to be combined to yield continuous production at inert gas volume percent levels below the maximum values exhibited by the individual wells. In this particular Example, the individual wells can operate in a fully-enhanced production mode until the produced inert gas volume percent from individual wells reaches 20 volume percent without exceeding a combined volume percent of about 15 percent. This eliminates the need for processing the combined well productions to reduce the inert gas volume percent below the specified 18 volume percent upper limit.

It should also be noted that overall production remains relatively high, as the summed production rate between times T5 and T10 always includes at least one well operating at the fully-enhanced production rate that results from continuous injection of inert gas into the formation.

The multiple well processes such as the "out-of-phase" process just described can include any number of wells as long as the inert gas volume percent maxima exhibited in the gaseous mixtures recovered from two or more of the wells occur at different points in time. The maximum benefit will, of course, be obtained where pairs of wells exhibit production histories similar to sine waves having a phase difference of 180 degrees. In other words, where minimizing inert gas volume percent in produced gas is a primary concern, pairs of wells should be operated so that gas produced from one well of the pair reaches its maximum value of inert gas volume percent at the same time the gas produced from the other well of the pair reaches a minimum value of inert gas volume percent.

Although it is somewhat counter-intuitive, the foregoing Example illustrates that in some cases, an overall production advantage may be gained by delaying the injection of inert gas into one well of a system. This is the case when delaying injection into a well starts that well on a recovery cycle that will place the well "out-of-phase" with respect to one or more wells whose outputs are to be combined. Although total recovery during a start-up period may be less under this regime, such delay may make it possible to avoid the need for post-recovery inert gas removal if the averaging of the "out-of-phase" well outputs can lower the cumulative inert gas volume percent below an operational upper limit.

Finally, it is believed that many of the inert gas volume percent reduction advantages obtained by suspending inert gas injection as shown in the foregoing Examples may be obtained by merely reducing the flow of injected inert gas. If the inert gas injection rate is reduced, the magnitude of the effect at the production well is expected to be proportional to the magnitude of the injection rate reduction, although results are expected to vary with reservoir depletion and other operating history as well as with the type of injected gas and the injectability of the reservoir. To achieve a practical effect, it may be necessary in many cases to reduce the injection rate by a factor of at least two.

It should be appreciated that various other embodiments of the invention will be apparent to those skilled in the art through modification or substitution without departing from the spirit and scope of the invention as defined in the following claims.

We claim:

1. A method for reducing the amount of an inert methane-desorbing gas present in a methane-containing gaseous mixture produced from a solid carbonaceous subterranean formation, said method comprising the steps of:

injecting an inert methane-desorbing gas into the formation;

thereafter suspending injection of the methane-desorbing gas;

recovering a first methane-containing gaseous mixture from the formation during at least a portion of the injecting step, said mixture having a first methane-desorbing gas volume percent; and recovering a second methane-containing gaseous mixture from the formation after performing the suspending step, said second gaseous mixture having a second methane-desorbing gas volume percent less than said first methane-desorbing gas volume percent.

2. The method of claim 1 wherein the first methane-desorbing gas volume percent is determined at a point in time immediately preceding performance of the suspending step.

3. The method of claim 1 wherein the second methane-containing gaseous mixture is recovered in the absence of inert gas injection.

4. The method of claim 2 wherein second methane-containing gaseous mixture is recovered in the absence of inert gas injection.

5. The method of claim 1 wherein the inert methane-desorbing gas is air.

6. The method of claim 1 wherein the inert methane-desorbing gas is an oxygen-depleted atmospheric air containing greater than about 80 volume percent nitrogen.

7. The method of claim 1 wherein the methane-containing gaseous mixture is recovered from a production well having a standard initial production rate of the methane-containing gaseous mixture, and wherein the first methane-containing gas is obtained at a rate greater than 1.1 times the standard initial production rate during at least a portion of the injecting step.

8. The method of claim 1 wherein the solid carbonaceous subterranean formation is a coal bed.

9. The method of claim 6 wherein the solid carbonaceous subterranean formation is a coal bed.

10. The method of claim 1 further including the step of resuming injection of the inert methane-desorbing gas after performing the suspending step.

11. The method of claim 10 further including the step of recovering a third methane-containing gaseous mixture from the formation during at least a portion of the resuming step.

12. The method of claim 11 wherein said third gaseous mixture has a third methane-desorbing gas volume percent greater than said first methane-desorbing gas volume percent.

13. A method for reducing the amount of an inert methane-desorbing gas present in a methane-containing mixture produced from a solid carbonaceous subterranean formation, said method comprising the steps of:

injecting an inert methane-desorbing gas at a first rate into the formation;

thereafter decreasing the rate of injection of the methane-desorbing gas to a second rate;

recovering a first methane-containing gaseous mixture from the formation while injecting the inert gas at the first rate, said mixture having a first methane-desorbing gas volume percent;

recovering a second methane-containing gaseous mixture from the formation while injecting at the second rate, said second gas having a second methane-desorbing gas volume percent less than said first methane-desorbing gas volume percent.

14. The method of claim 13 wherein the first methane-desorbing gas volume percent is determined at a point in time immediately preceding performance of the decreasing step.

15. The method of claim 13 wherein the second rate is less than one-half the first rate.

16. The method of claim 15 wherein the first methane-desorbing gas volume percent is determined at a point in time immediately preceding performance of the decreasing step.

17. The method of claim 13 wherein the inert methane-desorbing gas is selected from the group consisting of atmospheric air and oxygen-depleted atmospheric air.

18. The method of claim 13 wherein the inert methane-desorbing gas contains greater than about 80 volume percent nitrogen.

19. The method of claim 13 wherein the methane-containing gaseous mixture is recovered from a production well having a standard initial production rate of a methane-containing gaseous mixture, and wherein the first methane-containing gas is obtained at a rate greater than 1.1 times the standard initial production rate during at least a portion of the injecting step.

20. The method of claim 14 wherein the solid carbonaceous subterranean formation is a coal bed.

21. The method of claim 18 wherein the solid carbonaceous subterranean formation is a coal bed.

22. The method of claim 14 further including the step of increasing a rate of injection of the inert methane-desorbing gas to a third rate after performing the decreasing step.

23. The method of claim 22 further including the step of recovering a third methane-containing gaseous mixture from the formation during at least a portion of the the increasing step.

24. The method of claim 23 wherein the third gaseous mixture has a third methane-desorbing gas volume percent which is greater than [Y]the first methane-desorbing gas volume percent during at least a portion of the third gaseous mixture recovering step.

25. A method for reducing the amount of an inert methane-desorbing gas present in a methane-containing mixture produced from one or more solid carbonaceous subterranean formations, said method comprising the steps of:

injecting a first inert methane-desorbing gas at a first rate into a first formation location;

thereafter decreasing the rate of injection of the inert methane-desorbing gas to a second rate;

recovering a first methane-containing gaseous mixture from a first production well during at least a portion of the decreasing step, said mixture having a first methane-desorbing gas volume percent measured immediately prior to performing the decreasing step; and mixing the first methane-containing gaseous mixture with a second methane-containing gaseous mixture to produce a third methane-containing gaseous mixture having an inert methane-desorbing gas volume percent less than the first methane-desorbing gas volume percent.

26. The method of claim 25 in which the second methane-containing gaseous mixture has been produced by the steps of:

injecting a second inert methane-desorbing gas into a second formation location at a third rate;

decreasing the rate of injection of the second inert methane-desorbing gas to a fourth rate; and recovering the second methane-containing gaseous mixture from a second production well after performing the decreasing step.

27. The method of claim 26 in which the one or more solid carbonaceous subterranean formations are coal-beds.

28. The method of claim 26 wherein the first or the second inert methane desorbing gas comprises at least 90 volume percent nitrogen.

29. The method of claim 26 wherein the first or the second inert gas is selected from the group consisting of air or oxygen-depleted air.

30. The method of claim 25 wherein the second rate is 0.

31. The method of claim 27 wherein the second rate or the fourth rate is zero and wherein the first or the second inert methane-desorbing gas is at least 90 volume percent nitrogen.

* * * * *